US008764962B2

(12) United States Patent
Allanore et al.

(10) Patent No.: US 8,764,962 B2
(45) Date of Patent: Jul. 1, 2014

(54) EXTRACTION OF LIQUID ELEMENTS BY ELECTROLYSIS OF OXIDES

(75) Inventors: Antoine Allanore, Cambridge, MA (US); Donald R. Sadoway, Cambridge, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 28 days.

(21) Appl. No.: 13/213,834

(22) Filed: Aug. 19, 2011

(65) Prior Publication Data

US 2012/0043220 A1 Feb. 23, 2012

Related U.S. Application Data

(60) Provisional application No. 61/375,935, filed on Aug. 23, 2010, provisional application No. 61/489,565, filed on May 24, 2011.

(51) Int. Cl.
*C25C 3/00* (2006.01)

(52) U.S. Cl.
USPC ..... 205/367; 204/243.1; 204/290.12; 205/401

(58) Field of Classification Search
CPC ..... C25C 3/24; C25C 3/12; C25C 3/26; C25C 3/34
USPC ..... 205/354–411, 31, 587–593; 204/243.1, 204/290.01, 290.12
See application file for complete search history.

(56) References Cited

U.S. PATENT DOCUMENTS

| | | | | |
|---|---|---|---|---|
| 3,578,580 | A | 5/1971 | Schmidt-Hatting et al. | |
| 4,620,905 | A | 11/1986 | Tracy et al. | |
| 4,804,448 | A * | 2/1989 | Sammells et al. | 204/247 |
| 4,960,494 | A * | 10/1990 | Nguyen et al. | 205/384 |
| 6,375,813 | B1 * | 4/2002 | Hryn et al. | 204/290.01 |
| 6,521,116 | B2 | 2/2003 | Duruz et al. | |
| 6,913,682 | B2 * | 7/2005 | Duruz et al. | 205/387 |
| 7,033,469 | B2 | 4/2006 | Weirauch, Jr. et al. | |
| 7,235,161 | B2 | 6/2007 | DiMilia et al. | |
| 2006/0003084 | A1 * | 1/2006 | Nguyen | 427/58 |

(Continued)

FOREIGN PATENT DOCUMENTS

RO 120854 B1 8/2006

OTHER PUBLICATIONS

"Notification of Transmittal of the International Search Report and the Written Opinion of the International Searching Authority, or the Declaration," International Filing Date: Aug. 22, 2011, International Application No. PCT/US2011/001469, Applicant: Massachusetts Institute of Technology, Date of Mailing: Dec. 2, 2011, pp. 1-13.

(Continued)

*Primary Examiner* — Nicholas A Smith
*Assistant Examiner* — Ciel Thomas
(74) *Attorney, Agent, or Firm* — Sunstein Kann Murphy & Timbers LLP

(57) ABSTRACT

An electrolytic extraction method wins a target element from an oxide feedstock compound thereof. The feedstock compound is dissolved in an oxide melt in contact with a cathode and an anode in an electrolytic cell. During electrolysis the target element is deposited at a liquid cathode and coalesces therewith. Oxygen is evolved on an anode bearing a solid oxide layer, in contact with the oxide melt, over a metallic anode substrate.

43 Claims, 2 Drawing Sheets

(56) References Cited

U.S. PATENT DOCUMENTS

| | | | | |
|---|---|---|---|---|
| 2007/0144617 | A1 * | 6/2007 | De Nora et al. | 148/286 |
| 2007/0215483 | A1 | 9/2007 | Johansen et al. | |
| 2008/0023321 | A1 | 1/2008 | Sadoway | |
| 2008/0302655 | A1 * | 12/2008 | Fray et al. | 204/280 |

OTHER PUBLICATIONS

Fried, Naomi A., et al., "Titanium Extraction by Molten Oxide Electrolysis," Department of Materials Science & Engineering, Massachusetts Institute of Technology, Cambridge, MA, Mar. 15, 2004, pp. 1-24.

Sadoway, Donald R., "New Opportunities for Metals Extraction and Waste Treatment by Electrochemical Processing in Molten Salts," J. Mater Res., vol. 10, No. 3, Jan. 1, 1995, pp. 1-9.

Wang, Dihua, "Molten Oxide Electrolysis: Towards "Green" Steelmaking & Lunar in situ Resource Utilization,"3rd Reactive Metals Workshop, Department of Materials Science & Engineering, Massachusetts Institute of Technology, Cambridge, MA, Mar. 3, 2007, pp. 1-20.

"Certified Translation of Romanian Patent No. 120854B1," entitled: Method and installation for electrolysis in melts, for obtaining of iron-based alloys, and inert anodes for electrolysis of metal melts, by Landes Victor Spiridon, issued on Aug. 30, 2006, pp. 1-28.

* cited by examiner

EXTRACTION OF LIQUID ELEMENTS BY ELECTROLYSIS OF OXIDES

CROSS-REFERENCE TO RELATED APPLICATIONS

The present application claims the benefit of U.S. Provisional Patent Application Ser. No. 61/375,935, which was filed on Aug. 23, 2010, by Antoine Allanore et al. for METHOD AND APPARATUS FOR ELECTROLYSIS OF MOLTEN OXIDES, INCORPORATING METALLIC ALLOY ANODES, which is related to U.S. Provisional Patent Application Ser. No. 61/489,565, which was filed on May 24, 2011, by Antoine Allanore et al. for METHOD AND APPARATUS FOR ELECTROLYSIS OF MOLTEN OXIDES INCORPORATING METALLIC ALLOY ANODES, both of which are hereby incorporated by reference.

BACKGROUND OF THE INVENTION

1. Field of the Invention

The invention relates to extracting high-melting elements from oxide ores. In particular, this invention provides electrolytic methods incorporating metal anodes for electrowinning elements from oxide melts.

2. Background Information

The release of greenhouse gases is an intrinsic result of traditional smelting methods for most metals. For example, iron produced conventionally in a blast furnace entails significant process emissions related to coke production and reduction of iron ore. Combustion operations further contribute to carbon emissions with ancillary process steps such as ore preparation. Making steel from pig iron further entails energy consumption, for example in an electric arc furnace, which may be provided by fossil fuel combustion. Iron- and steel-making are believed to contribute several percent of the worldwide greenhouse gas emissions.

As the tolerance for greenhouse gas emissions diminishes, finding replacement technologies for basic metal smelting operations is becoming critical. There is, accordingly, a need for metal-extraction techniques that function with reduced use of carbon and carbon-based fuels.

In parallel, there is growing interest in producing metal product containing dissolved carbon at concentrations difficult to achieve with conventional technology at an acceptable cost. Hence, there is value to be placed on a carbon-free extraction technology that can produce metal of exceptional purity.

SUMMARY OF THE INVENTION

In a method of extracting a target element from an oxide feedstock compound incorporating the target element, a liquid electrolyte, at least 75% oxide by weight, is provided. The oxide feedstock is dissolved in the liquid electrolyte. An anode including a metallic anode substrate is provided in contact with the electrolyte. A cathode is in contact with the electrolyte, opposite the anode. The dissolved oxide feedstock is electrolyzed as electrons are driven from oxygen precursors in the electrolyte into the metallic substrate across an oxide layer on the substrate to form gaseous oxygen. Species in the electrolyte bearing the target element are reduced to form the target element at the cathode.

In another embodiment, a method of extracting a target element from an oxide feedstock incorporating the target element provides a liquid electrolyte in which the oxide feedstock is dissolved. An anode in contact with the electrolyte at an interface includes a metallic anode substrate. At least 50% by weight of the substrate is of at least one element more reactive with respect to oxygen than the target element at an operating temperature of the interface. A liquid cathode is in contact with the electrolyte, opposite the anode. The dissolved oxide feedstock is electrolyzed as electrons are driven from oxygen precursors in the electrolyte into the metallic substrate across an oxide layer on the substrate to form gaseous oxygen. Species in the electrolyte bearing the target element are reduced to form the target element at the cathode.

In another embodiment a method of extracting iron from an oxide feedstock provides a liquid electrolyte, at least 75% oxide by weight, in which the oxide feedstock is dissolved. An anode in contact with the electrolyte includes a metallic anode substrate. The substrate is least 50% by weight chromium and at least 1% by weight iron. A liquid cathode is in contact with the electrolyte, opposite the anode. The dissolved oxide feedstock is electrolyzed as electrons are driven from oxygen precursors in the electrolyte into the metallic substrate to form gaseous oxygen. Species in the electrolyte bearing the target element are reduced to form the target element at the cathode.

An apparatus comprises a liquid electrolyte, at least 75% oxide by weight, including oxygen precursors and species bearing a target element, arising from an oxide feedstock compound dissolved in the electrolyte. A liquid cathode is in contact with the electrolyte. An anode is in contact with the electrolyte opposite the cathode. The anode includes a metallic anode substrate and a solid oxide layer meeting the electrolyte at a contact interface. The apparatus is operable, upon connection of the anode and the cathode to a power source, to electrolyze the dissolved oxide feedstock compound, drive electrons from the oxygen precursors across the solid oxide layer to form gaseous oxygen and reduce the species bearing the target element to form the target element at the cathode In another embodiment, an apparatus includes a liquid electrolyte, at least 75% oxide by weight, that includes oxygen precursors and species bearing iron, arising from an oxide feedstock compound dissolved in the electrolyte. A liquid cathode is in contact with the electrolyte. An anode contacts the electrolyte opposite the cathode. The anode includes a metallic anode substrate which is at least 50% by weight chromium and at least 1% by weight iron. The apparatus is operable, upon connection of the anode and the cathode to a power source, to electrolyze the dissolved oxide feedstock compound, drive electrons from the oxygen precursors to form gaseous oxygen and reduce the species bearing iron to form iron at the cathode.

BRIEF DESCRIPTION OF THE DRAWINGS

The foregoing discussion will be understood more readily from the following detailed description of the invention, when taken in conjunction with the accompanying drawings, in which like reference numerals indicate identical or functionally similar elements.

It will be appreciated that these figures are not necessarily drawn to scale.

DETAILED DESCRIPTION OF AN ILLUSTRATIVE EMBODIMENT

Molten oxide electrolysis ("MOE") entails the direct electrolysis of an oxide feedstock compound to extract a target element therefrom. MOE wins the target metal with production of gaseous oxygen and without, or with reduced, release of carbon dioxide or other objectionable fugitive species. Because the target metal is reduced directly from oxide, preparatory processing of source compounds is much cleaner and simpler than for conventional extraction techniques in the case of many metals. MOE has the potential to produce metal of exceptional purity, especially with regard to so-called interstitial elements, namely carbon and nitrogen. Since MOE may produce a target element in liquid form, difficulties associated with dendritic deposits are avoided. MOE is furthermore energy efficient for extraction of an element in its liquid state in that irreversibilities necessarily accompanying the flow of electric current through components of an electrolytic cell also serve to maintain cell components at the requisite high temperatures.

The target element may have a high melting temperature, illustratively greater than 1200° C. or 1400° C. Examples include manganese ($T_m$=1246° C.), silicon (($T_m$=1414° C.), nickel ($T_m$=1455° C.), cobalt ($T_m$=1495° C.), iron ($T_m$=1538° C.), titanium ($T_m$=1670° C.), zirconium ($T_m$=1855° C.), chromium ($T_m$=1907° C.).

Candidate oxide feedstock compounds incorporate the desired target element and oxygen. For example, possible oxide feedstock compounds for titanium extraction include but are not limited to, e.g., titanium monoxide (TiO), titanium sesquioxide ($Ti_2O_3$), titanium dioxide ($TiO_2$). Nickel may be extracted from a nickel oxide such as NiO. Iron may be extracted from an iron oxide such as ferric oxide ($Fe_2O_3$) or ferrous ferric oxide ($Fe_3O_4$) feedstock. Chromium may be extracted from chromium oxide ($Cr_2O_3$). Manganese may be extracted from a manganese oxide such as MnO, $Mn_3O_4$, $Mn_2O_3$, $MnO_2$ or $Mn_2O_7$. A mixed-oxide phase such as chromite (FeCr2O4) and ilmenite (FeTiO3) as a feedstock compound may afford deposition of two elements from a single compound.

Figure 1:
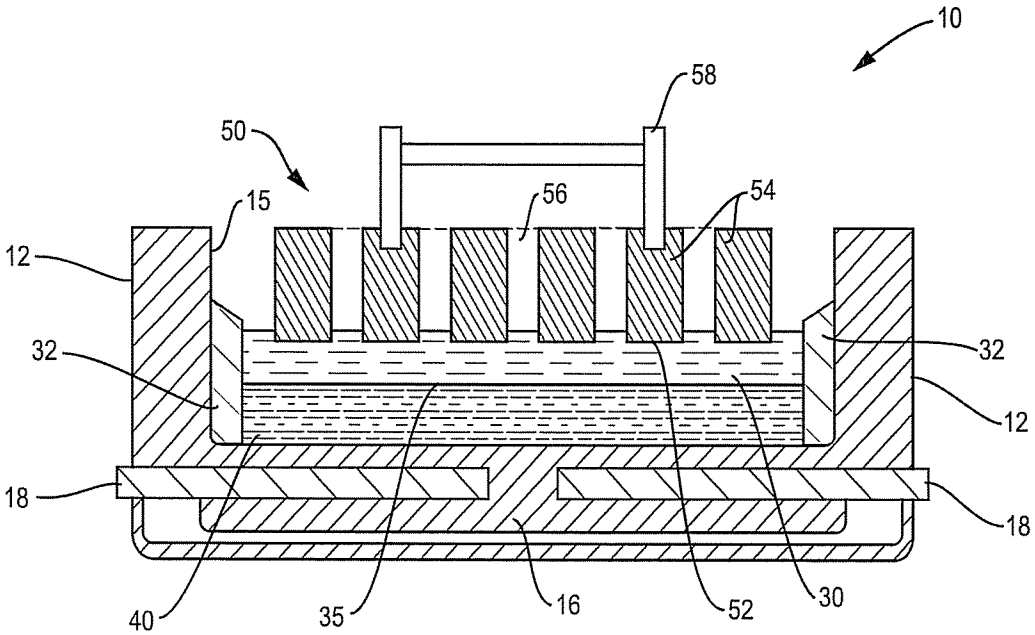
FIG. 1 is a vertical section showing an electrochemical apparatus configured to extract a target element from an oxide feedstock compound, in accordance with the invention.
Figure 2:
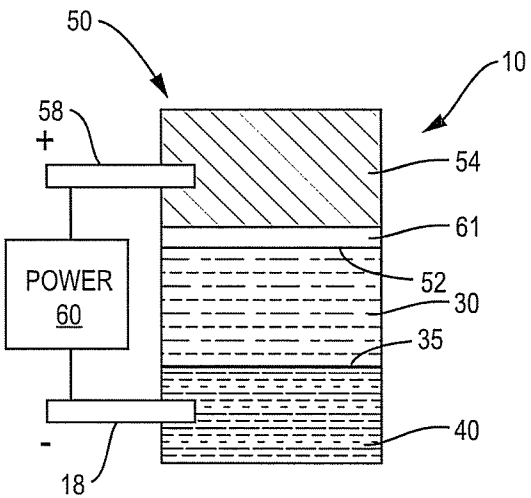
FIG. 2 is a schematic showing the electrochemical apparatus of FIG. 1 configured in a circuit with a power source in accordance with the invention.

With reference to FIG. 1 and FIG. 2, in an illustrative embodiment, an electrometallurgical cell operable to extract a target element from an oxide feedstock compound comprises a liquid electrolyte 30, a cathode 40 and an anode 50. The electrolyte 30 and the cathode 40 are contained by a cell shell or housing 12.

The cathode 40 is illustratively a liquid body incorporating the target element. The interior of the housing 12 illustratively provides an electronically conductive cathode substrate 16 on which the cathode 40 rests. The cathode substrate 16 is illustratively of a material resistant to attack by the cathode 40. For some embodiments, the cathode substrate 16 may be molybdenum. Cathodic metallic current collector bars 18 embedded in the cathode substrate 16 enable connection of the cathode 40 to an external power source 60 and serve as the negative terminal during operation of the cell 10.

The electrolyte 30 meets the cathode 40 at an electrolyte-electrode interface 35. The electrolyte 30 is a liquid capable of dissolving the oxide feedstock incorporating the target element. Illustratively the electrolyte 30 is a molten oxide mixture or oxide melt. The apparatus 10 is illustratively operated under conditions that cause a peripheral frozen electrolyte layer 32 to form between the oxide melt 30 and the interior sides 15 of the housing 12. The frozen electrolyte layer 32 protects the interior sides 15 from chemical attack by the oxide melt 30.

The anode 50 dips into the electrolyte 30 opposite the cathode 40. The anode 50 may be a single, continuous body. Illustratively channels 56 machined through the anode 50 are configured as respective pathways between the upper surface of the electrolyte 30 and the exterior of the cell 10. An electronically conductive metallic anode substrate 54 illustratively bears a solid oxide layer 61 constituted to limit consumption of the substrate 54 to an acceptable level during operation of the cell 10. The anode 50 meets the electrolyte 30 at a contact interface 52 therewith. Electrically conductive metallic anode rods 58 embedded in the anode 50 are configured to enable connection of the anode 50 to the external power source 60 and serve as the positive terminal during operation of the cell 10.

Equivalently, a plurality of substantially identical anode blocks constitute the anode 50. The conductive metallic anode substrate 54 of each of the blocks illustratively bears a solid oxide layer 61. The anode blocks are in electrical communication with a common anodic collector 58, have a common electrical potential, and are arranged with spaces therebetween constituting the channels 56.

The respective compositions of the electrolyte 30, anode 50 and cathode 40, housing 12 and other features of the cell 10, are selected conjunctionally for mutual compatibility and to ensure practical operating parameters and lifetime of the cell 10.

The liquid cathode 40 may be substantially identical in composition to the desired target element. Alternatively, the liquid cathode 40 additionally contains elements other than the target element produced. A molten metal host or heel made of a metal more noble than the target metal may serve as the cathode 40, e.g., a molten copper cathode 40 into which nickel is deposited by or a molten iron cathode 40 into which chromium is deposited. This situation may be consistent with direct production of an alloy of desired composition by adding, through reduction of species in the electrolyte 30 as described below, one or more elements to alloy constituents already in the cathode 40. A cathode 40 having a composition into which the produced target element readily alloys constitutes an environment of reduced activity of the target element compared to a mono-elemental liquid body. In this case, the voltage needed to convert the feedstock oxide compound to the target element by MOE in the cell 10 is correspondingly reduced. A multi-elemental cathode may also allow the MOE cell 10 to be operated at a temperature lower than the melting temperature of the target element while producing a liquid product. In a variation, the cathode 40 may be a solid body.

The electrolyte 30 of the cell 10 is in general a solvent, one or more supporting compounds and other, optional ingredients dissolved therein. The electrolyte 30 dissolves the oxide feedstock, providing oxygen-bearing anionic species and cationic precursors to the target element to be produced.

As used herein with respect to the electrolyte 30, the term oxide melt denotes a liquid obtained by melting one or more solid oxides, the oxides contributing at least 25%, 50%, 75%, 85% or more of the weight of the electrolyte 30. Illustratively the electrolyte composition fulfills several criteria. The composition of the oxide melt 30 for extracting a target high-melting element is selected for its capability to dissolve the feedstock compound bearing the target element as well as for other chemical and physical properties, known to those skilled in the art. The electrolyte 30 illustratively has a melting temperature lower than the melting point of the target element (or an alloy constituting the cathode 40), thereby allowing operation of the MOE cell 10 with adequate electrolyte fluidity. An electrolyte 30 having density much lower than that of the target element under the operating temperature profile in the MOE cell 10 allows gravity-driven separation of the electrolyte 30 from the target element deposited at the cathode 40.

The electrical conductivity of the electrolyte 30 is illustratively low enough that at practical values of interelectrode separation and current density the amount of Joule heating is sufficient to maintain the desired high operating temperatures in the MOE cell 10. Illustratively the electrical conductivity of the electrolyte may be on the order of 0.5 to 1.0 or 2.0 S/cm. For a relatively small anode-cathode spacing the electrolyte conductivity may be less than 0.5 S/cm. A relatively low electronic contribution to the electrical conductivity of the liquid electrolyte, i.e., on the order of less than 10% of the total electrical conductivity, allows production of an element by MOE at an acceptably high Faradaic efficiency. Low vapor pressure of electrolyte constituents at temperatures inside the cell 10 and high decomposition potentials of electrolyte constituents compared to that of the feedstock compound limit the loss of material from the electrolyte 30 and the change in its composition over the lifetime of the MOE cell 10.

The molten oxide electrolyte 30 may incorporate, e.g., silica, alumina, magnesia and calcia. Liquids comprising calcium oxide (CaO) may be, by virtue of its position in the electrochemical series, suitable oxide melts. For example, liquids based in the binary magnesium oxide-calcium oxide (MgO—CaO) system, with additions of silicon dioxide ($SiO_2$), alumina ($Al_2O_3$) or other oxides, may provide suitable oxide melts for extracting relatively unreactive high-melting metal product elements, such as nickel, iron or chromium. The electrolyte 30 may incorporate an oxide bearing one or more of beryllium, strontium, barium, thorium, uranium, hafnium, zirconium, and a rare-earth metal. As used herein, the rare-earth metals are the fifteen lanthanides plus scandium and yttrium. The mentioned electrolyte constituents may also be incorporated in the anode 50 to advantage during electrolysis in the cell 10 as described below with reference to FIG. 4.

The illustrative anode 50 is constituted to serve mainly as an electron sink with its surface at the contact interface 52 illustratively presenting a surface capable of sustaining the evolution of oxygen gas at an acceptable voltage. Accordingly the portion of the anode 50 meeting the electrolyte 30 in the cell 10 is substantially inert, constituted to be stable in a corrosive environment and at high temperatures. Thus the anode 50 may require less frequent replacement than a conventional consumable anode. The relatively stable contour at the contact interface 52 afforded by the composition at the interface 52 may permit a closer spacing between the cathode 40 and the anode 50. This arrangement requires a lower voltage to drive electrolysis and hence a lower power cost per unit of target element produced than would a larger spacing.

The metallic character of the substrate 54 endows the anode 50 with advantages relative to cost and ease of manufacturing in large complex shapes compared to high-temperature materials such as graphite, composites, or ceramics. The illustrative anode 50 thus may operate at a considerably lower temperature than the cathode 40, for example due to cooling induced by gas evolution at the interface 52.

The metallic anode substrate 54 includes a continuous metallic phase. The metallic phase may be constituted chiefly by a majority metallic element. The word element as used herein with reference to the anode 50 has its normal chemical sense, denoting an element of the periodic table. Candidate elements for the majority metallic element in the anode substrate 54 in a given cell 10 include e.g., Sc, Ti, V, Cr, Mn, Fe, Co, Ni, Y, Zr, Nb, Mo, Hf, Ta, W, one of the noble metals, or the target element to be produced in the cell 10. The majority metallic element in the anode substrate 54 may be more reactive with respect to oxygen than the target element at an operating temperature of the interface 52. In other words, the Gibbs energy of oxide formation for the majority metallic element may be of larger magnitude than that for the desired target element, or the oxide of the majority metallic element is more stable than an oxide of the target element. Alternatively, the majority metallic element may be the target element. Several of the target element candidate elements listed above and/or elements having stable oxides may together constitute more than 50% of the anode substrate 54. The metallic phase may be nominally mono-elemental, i.e., of a majority element except for unspecified impurities at low levels, e.g., up to on the order of 0.01%, 0.1% or 1% by weight.

Alternatively, the metallic phase of the substrate 54 may be an alloy incorporating a majority metallic element and an additional, minority element or a plurality of such minority elements. The majority metallic element may be present in the substrate 54 at a concentration by weight of 50%, 60%, 70%, 80%, 90% or more. The one or more added metallic elements in the substrate 54 may be collectively present at concentrations of at least 1%, 5%, 10%, 15% 25%, 35%, or 45% by weight of the total metallic content of the alloy. An individual minority element may constitute at least 0.1%, 1%, 5%, 10%, 15% or 25% by weight of the total metallic content of the alloy.

The alloy in the substrate 54 may be compositionally graded, with the concentration of the majority metallic element increasing or decreasing with distance away from the contact interface. In one embodiment, the substrate 54, whether it be of constant or varying composition, constitutes substantially the entire anode 50, aside from the oxide layer 61 overlying the substrate 54. In an alternative embodiment, the anode 50 comprises a continuous anode-alloy integument, which is the substrate 54, overlaying a core of metal having lower cost than and being compatible with the alloy of the substrate 54, for example in melting temperature and thermal expansion properties. The transition between the substrate and the core may be abrupt or achieved by compositional grading.

A minority elemental constituent, constituting less than 50% by weight of the anode substrate 54 illustratively falls into one of the following classes; a high-melting element, enumerated above as a possible target element; an element for which the Gibbs energy of oxide formation is of smaller magnitude than for the desired target element at the operating temperature of the interface 52 in the cell 10 and which combines with a majority metallic element to form an alloy melting at an acceptably high temperature; beryllium, strontium, barium, thorium, uranium, hafnium, zirconium, or a rare-earth metal; or another element having a high melting point and forming an oxidation-resistant oxide under operating conditions in the cell 10.

The invention not being limited by any theory, a constituent element in the anode substrate 54 may be stably bound to oxygen under the operating conditions of the cell 10, the constituent forming part of the solid oxide layer 61 at the interface 52. Thus, any reaction in the cell 10 involving a constituent of the anode substrate 54, for example with an ingredient of the oxide melt 30 or any species produced at the contact interface 52, may be self-limiting. An oxide in the solid oxide layer 61 at the contact interface 52 may be more stable than an oxide feedstock compound undergoing electrolysis to produce the target element. Thus the solid oxide layer 61 at the interface 52 may protect the substrate 54 from wholesale consumption during electrolysis of the feedstock compound in the cell 10. Elements originating in the electrolyte 30 may also be fixed in the solid oxide at the interface 52.

In one approach, the majority metallic element in the substrate 54 is the same element as the target element. In this case, the solid oxide layer 61 may encompass regions having the same composition as the oxide feedstock compound from which the target element is being extracted. Thus adventitious electrolysis of the oxide in the solid oxide layer 61 may augment the target element deposited at the cathode 40 without introducing undesirable contaminants into it. Nonetheless, the cell 10 may be operated to maintain oxygen-saturation conditions at the contact interface 52, thereby supporting the solid oxide layer 61 and consequently limiting consumption of the anode 50. For example, the electrolyte 30 may be saturated with respect to the oxide feedstock compound of the target element. Such saturation may be maintained by providing a sufficient quantity of the oxide feedstock compound in contact with the melt 30 before beginning cell operation. Or, saturation in the melt 30 may be established during a transient start-up period during which the anode releases material into the melt 30. Alternatively local saturation of the melt 30 with respect to oxygen is established by generation of oxygen gas at the interface 52 during electrolysis.

In some embodiments, the anode 50 has chromium as its majority metallic element. The abundance and relatively low cost of chromium is consistent with its use in an industrial-scale metal extraction process such as MOE. The physical properties of chromium facilitate anode fabrication and handling at high temperatures. In one embodiment, the chromium-based anode 50 furthermore incorporates at least another transition or refractory metal, e.g., tantalum and/or vanadium. Such a chromium-group anode 50 may be useful in the cell 10 at temperatures as high as 1500° C. or greater. In another embodiment, the refractory-metal anode furthermore incorporates iron. The iron may be present at a weight percent greater than 5%, 10%, 15%, 20%, 25% or 30%.

In an exemplary process sequence effecting production of a chosen target element from an oxide feedstock compound in the cell 10, the anode 50 is first held clear of the electrolyte 30, thereby leaving the circuit that includes the power source 60 and the cell 10 incomplete. The oxide compound is introduced into the electrolyte 30, the compound dissolving in the electrolyte 30 and being thereafter present therein in the form of respective ionic species bearing the target element and oxygen. The power source 60 is operated in the incomplete circuit as if to deliver a desired current through the cathode 40 and the anode 50. The anode 50 is thereby anodically polarized. The anode 50 is lowered in its polarized state into the electrolyte 30 to form the interface 52 therewith, thereby completing the circuit that includes the source 60 and the cell 10, allowing current to flow through the cell 10 and initiating electrolysis in the cell 10.

During operation of the power source 60, oxygen precursors in the electrolyte 30 migrate to the contact interface 52, illustratively on surfaces of the anode 50 facing the cathode 40 and surfaces lining the channels 56. Electrons are removed from the oxygen precursors, driven across the oxide layer 61 at the contact interface 52 and through the metallic substrate 54 of the anode 50 through the anode rods 58. Species in the electrolyte 30 are thereby oxidized at the contact interface 52 to form gaseous oxygen anodically. Gas constituted primarily of oxygen is thereby generated at the contact interface 52, passes through the channels 56, and exits the cell 10. During electrolysis, the anode 50 may sustain current densities, averaged over the interface 52 with the electrolyte 30, on the order of or greater than, e.g., 0.05 A/cm$^2$, 0.5 A/cm$^2$, 1 A/cm$^2$, 5 A/cm$^2$ or 10 A/cm$^2$.

Concurrently, the power source 60 delivers electrons through the collector bars 18, the cathode substrate 16, and the cathode 40. At the electrolyte-electrode interface 35 electrons are transferred to species in the electrolyte 40 bearing the target element. The species are thereby reduced, with production of the target element in liquid form. The material produced accrues to the cathode 40 and functions as part of the cathode 40 thereafter. The target metal may constitute on the order of 80%, 90%, 95%, 99% or more by weight of material produced by reduction at the cathode.

The cell 10 may be initially configured to include at least one element in the cathode 40 that is not the target element. Thus the output of electrolysis in the cell 10 may provide the target element in a liquid alloy that constitutes the cathode 40 as the operation of the cell 10 continues. The target element may be periodically removed from the cathode 40 by, e.g., tapping the cell 10. The cell 10 may be operated to produce the target element continuously by continual additions of the oxide feedstock compound. In a variation, more than one target element may be deposited at the liquid cathode 40 during operation of the cell 10 by simultaneous or sequential electrolysis of species originating in respective distinct oxide feedstock compounds or a single mixed oxide dissolved in the electrolyte 30.

Figure 3:
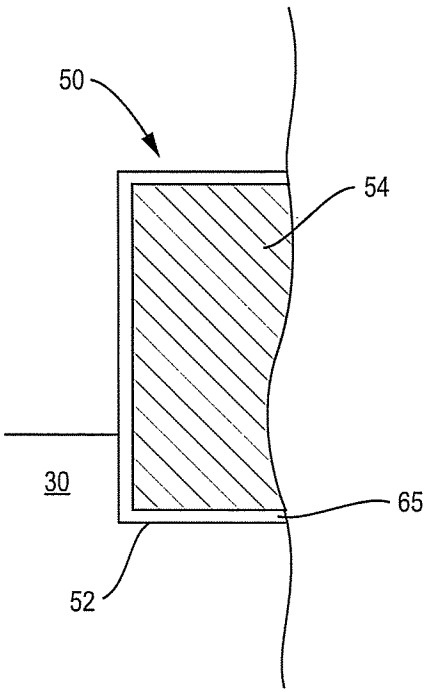
FIG. 3 is a vertical section showing a portion of an anode on which an oxide layer has been formed over a substrate by pre-electrolysis in the electrochemical apparatus in accordance with the invention.

Without being bound by any theory, one or more mechanisms may account for the composition solid oxide layer 61. Oxide may be generated on the metallic anode substrate 54 before the anode 50 is placed in the cell 10 from metallic elements originating in the metallic anode substrate 54. In one embodiment, the anode 50 is treated in an oxidizing atmosphere at high temperature to grow oxide over the metallic anode substrate 54. FIG. 3 shows a portion of the anode 50 placed in the electrolyte 30 after a preformed oxide layer 65 was grown on the anode 50 outside the cell 10 (FIG. 1). Methods of generating an oxide layer on a metallic body are known by those skilled in the art.

Figure 4:
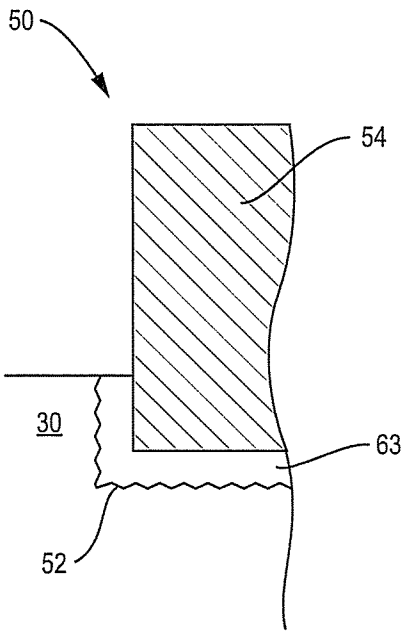
FIG. 4 is a vertical section showing a portion of an anode on which a preformed has been formed before placement in the electrochemical apparatus in accordance with the invention.

Oxide also may be generated on the anode 50 after it is placed in contact with the oxide melt 30 in the cell 10. In this case, oxygen from the electrolyte 30 oxidizes constituents of the anode substrate 54 and becomes part of the anode 50. FIG. 4 shows a portion of the anode 50 after an in situ oxide layer 63 has been generated by operation of the external power source 60 (FIG. 2) connected across the collector bars 18 and anode rods 58. With continuing reference to FIG. 2 and FIG. 4, other elemental constituents of the electrolyte 30 may also be incorporated by the in situ oxide layer 63. The in situ oxide layer 63 may be initially generated during an electrolysis operation in the cell 10 that does not produce the target element at the cathode 40. Alternatively, the in situ oxide layer 63 may be initially generated early in the electrolysis of the dissolved oxide feedstock compound with production of the target metal. The early consumption of a relatively small portion of the anode substrate 54 behind the contact interface 52 illustratively protects the anode 50 from wholesale consumption during extended continuous electrolytic production of the target metal as described above. The oxide layer 63 may incorporate regions of spinel. An electronically conductive spinel at the contact interface 52 may support desirable production rates of the metal by facilitating electron transfer from the contact interface 52 to the metallic substrate 54. Rare earth elements transferred from the electrolyte 30 and incorporated in the solid oxide layer 61 at concentrations around, e.g., 0.1% to 1.0% may enhance the stability of the oxide layer 61. Rare earth elements may further be incorporated into the metallic substrate 54 thereby enhancing the stability of the interface between the metallic substrate 54 and the oxide layer 61.

With reference to FIG. 2, FIG. 3 and FIG. 4, the solid oxide layer 61 may include metal-oxygen associations formed by the pre-electrolysis process described for the layer 65, the in situ process described for the oxide layer 63, or both. In one embodiment, the solid oxide layer 61 is stratified, the substrate 54 bearing a preformed oxide layer covered by an in situ oxide layer meeting the electrolyte 30 at the interface 52. Alternatively, the solid oxide layer 61 at the interface 52 may present respective regions of the preformed oxide layer and in situ oxide layer to the electrolyte 30. For example, spinel may be precipitated during electrolysis at sites of slag intrusion through a layer of preformed oxide of the majority element.

As an example of a specific application of MOE, iron extraction may be instructive relative to benefits and considerations relevant to the illustrative apparatus and method. Used to produce iron and/or steel, in one embodiment MOE proceeds according to $$2Fe_2O_3(S) \rightarrow 4Fe^{3+} + 6O^{2-} \rightarrow 4Fe(l) + 3O_2(g),$$

thereby affording drastic mitigation of greenhouse gas emissions compared to conventional approaches to making iron and steel. Carbon dioxide mitigation by MOE may be achieved even when the electrolysis producing iron in the cell 10 is driven by electricity produced by fossil fuel combustion, e.g., as in the case of natural gas.

MOE may accommodate a range of grades, particle sizes and morphologies of iron ore to be dissolved in the molten oxide mixture 30. Fine and ultrafine particles of the oxide feedstock material may be introduced directly into the MOE cell. Thus, MOE may operate without the energy consumption and other expenses of pelletization or sintering unit operations applied conventionally before iron extraction. In principle the MOE approach converts iron oxide to liquid metal in a single step. It is expected that in principle any iron oxide phase, including magnetite and hematite, could be introduced into the slag and finally dissolved in the oxide melt.

Furthermore, the chemical selectivity of electrolysis may ensure the absence of phosphorus or other gangue elements from the iron deposited at the cathode 40. The metal produced at the cathode 40 may contain a high fraction of iron, for example 90%, 95%, 99%, 99.9% or greater by weight. The production of iron or steel of a desired purity may therefore be possible from lower-grade iron ore, undesirable elements being stabilized in ionic form in the electrolyte owing to their more negative decomposition potentials. The selectivity of MOE and the virtual absence of carbon from the components of the illustrative electrolysis cell 10, particularly the anode 50, especially suit the iron product at the cathode 40 to serve as the basis for high-purity alloys or low-carbon formulations such as stainless steels.

The mixed-oxide liquid electrolyte 30, or slag, used in an MOE apparatus such as the cell 10 to extract iron may have the liquid properties of fluidity and density desired for slags known in conventional iron-extraction contexts. For electrolytic extraction of pure iron by MOE, the electrolyte 30 illustratively has a melting temperature between about 1350° C. and 1450° C., with lower melting temperatures permissible when producing an alloy at the cathode 40 as described above. Liquids in the $CaO—MgO—Al_2O_3—SiO_2$ system, with additions of, e.g., yttria, zirconia or thoria may be suitable electrolytes for iron extraction.

Another electrolyte composition selection criterion relates to the mixed valency of iron. For a slag in equilibrium with atmospheric pressure and composition, octahedrally coordinated iron cations in an oxide melt bring about the formation of the iron polaron, which can enable electrons to move through the slag 30. Iron (II) assumes octahedral coordination whereas iron (III) assumes a distribution over both tetrahedral and octahedral coordination geometries. It may be that highly basic slags tend to stabilize tetrahedrally coordinated iron (III) and reduces the concentration of iron (II) and octahedrally coordinated iron (III), thereby limiting electronic conductivity in the slag. Additionally, basic slags are ionic melts with in which electrical current is carried by small alkali metal or alkaline-earth metal cations. Accordingly transport phenomena and chemical reactions are relatively fast.

The cathode 40 in an iron-winning cell 10 may be a pool of nominally pure liquid iron which is augmented by electrolysis during cell operation. Liquid iron of ultra-high purity may be produced as a master melt to which alloy addition may be executed simply. The interface 35 between the electrolyte 30 and the cathode 40 for pure iron production may be at a temperature greater than the melting temperature of iron. Alternatively, the liquid body may be, e.g., molten cast iron or steel, allowing production of iron alloys of desired composition with temperatures less than 1500° C. at the interface 35. For example, MOE adding iron to a cast-iron cathode 40 may operate at an interface temperature of about 1480° C. down to carbon contents of around 2 atomic percent.

In one embodiment of the cell 10 adapted to win iron from an iron feedstock, the anode 50 includes a substrate 54 in which the majority element is chromium. The anode may form an oxide layer containing regions of chromium oxide and electronically conductive spinel at the contact interface 52 with the electrolyte 30 during electrolysis in the cell 10. A majority-chromium substrate 54 in an iron-winning cell 10 may also contain vanadium or tantalum.

The anode substrate 54 in an iron-winning cell 10 may contain iron, with chromium present at a concentration greater than 25%, 50%, 70%, 75%, 80%, or 90% by weight. The iron may be present in the anode substrate 54 at a concentration greater than 5%, 10%, 15%, 20%, or 25% by weight. Illustratively the Cr—Fe anode substrate 54 is pre-oxidized to form a preformed layer 65 (FIG. 3) of $Cr_2O_3$ before placement in the cell 10. For example, a Cr-based anode substrate 54, illustratively 70% Cr and 30% Fe by weight, may be treated for two hours at 1450° C. in an argon atmosphere with 50 ppm oxygen to create an anode 50 with an oxide scale 65 thereon. Such an anode 50 may develop an in situ layer of (Cr, Al, Mg, Fe, Ca) oxide, including spinel regions, over the pre-electrolysis scale 65 during iron production by electrolysis in the cell 10 with a $CaO—MgO—Al_2O_3—SiO_2$ electrolyte. In a variation, the electrolyte 30 may further include $ZrO_2$ and the in situ oxide layer further incorporate Zr.

The illustrative electrolytic apparatus 10 is not limited to any particular method of being brought to or remaining at operating temperature. During initial cell assembly, a liquid constituent such as the electrolyte may be initially melted in a separate heated chamber with sufficient superheat to allow transfer into the housing of the electrolytic cell. In another approach external heaters are used before or during operation, placed, for example, in the cell housing wall. Or, the liquids in the housing may be self-heating during operation through applied overpotentials or resistive heating through DC or AC current passing through the electrolyte 30. Practical aspects of electrometallurgical systems potentially helpful to implementation of the illustrative method and apparatus, such as construction of high-temperature apparatus for containing molten salts and liquid metals, and management of temperature profiles in their use, are known to those skilled in the art.

Although specific features are included in some embodiments and drawings and not in others, it should be noted that each feature may be combined with any or all of the other features in accordance with the invention. It will therefore be seen that the foregoing represents a highly advantageous approach to extracting an element from an oxide, particularly for metals that melt at high temperatures. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A method of extracting a target element from an oxide feedstock of the target element, the method comprising:

providing a liquid oxide electrolyte comprising at least 75% by weight of one or more oxide compounds, in which the oxide feedstock is dissolved forming ionic oxygen species and ionic target element species;

providing an anode comprising a metallic anode substrate wherein one element constitutes at least 50% by weight of the metallic anode substrate, and wherein the one element is more reactive with respect to oxygen than the target element, the metallic anode substrate having a solid oxide layer comprising one or more oxides selected from the group consisting of the target element, the metallic anode substrate and the electrolyte, the anode in contact with the electrolyte;

providing a cathode in contact with the electrolyte;

driving electrons from the ionic oxygen species in the electrolyte into the metallic substrate across the solid oxide layer thereon so as to form gaseous oxygen; and reducing the ionic target element species in the electrolyte to form a liquid of the target element at the cathode, the target element having a melting temperature greater than 1200° C.

2. The method of claim 1 wherein the oxide layer comprises an oxide of an element of the metallic anode substrate and the target element.

3. The method of claim 1 wherein the oxide layer comprises an oxide of the metallic anode substrate and the electrolyte.

4. The method of claim 2 further comprising forming the oxide layer by oxidizing material in the metallic substrate before the anode contacts the electrolyte.

5. The method of claim 1 wherein the metallic anode substrate comprises at least one of scandium, titanium, vanadium, chromium, manganese, iron, cobalt, nickel, zirconium, niobium, molybdenum, hafnium, tungsten and tantalum.

6. The method of claim 1 wherein the metallic anode substrate is an alloy.

7. The method of claim 5 wherein one of scandium, titanium, vanadium, manganese, iron, cobalt, nickel, yttrium, zirconium, niobium, molybdenum, hafnium, tungsten and tantalum constitutes at least 70% by weight of the metallic anode substrate.

8. The method of claim 5 wherein chromium constitutes at least 70% by weight of the metallic anode substrate.

9. The method of claim 5 wherein the target element constitutes at least 1% by weight of the metallic anode substrate.

10. The method of claim 5 further comprising at least 0.1% by weight of the metallic anode substrate is thorium, hafnium, zirconium or yttrium.

11. The method of claim 1 wherein the target element is one of titanium, nickel, manganese, cobalt, zirconium, chromium and silicon.

12. The method of claim 1 further comprising reducing species in the electrolyte bearing an additional element to form the additional element at the cathode simultaneously with forming the target element.

13. The method of claim 1 wherein the target element is iron and the feedstock compound is an iron oxide.

14. The method of claim 13 wherein the cathode is liquid carbon steel.

15. The method of claim 1 wherein the target element constitutes at least 90% by weight of material formed by reduction at the cathode during electrolysis.

16. The method of claim 1 wherein electrons cross the oxide layer at an average current density greater than 0.05 $A/cm^2$ during electrolysis.

17. The method of claim 1 wherein electronic conductivity accounts for less than 10% of electrical conductivity in the electrolyte.

18. The method of claim 1 wherein the oxide layer comprises an electronically conductive oxide phase.

19. The method of claim 1 wherein the target element is titanium.

20. The method of claim 1 wherein the target element is formed at a temperature greater than 1400° C. at the cathode.

21. The method of claim 1 wherein the electrolyte comprises an oxide of thorium, uranium, beryllium, strontium, barium, hafnium, zirconium or a rare earth element.

22. The method of claim 1 wherein the cathode is a liquid body.

23. The method of claim 1 wherein the target metal is iron and the anode substrate is at least 50% chromium by weight.

24. The method of claim 23 wherein the metallic anode substrate incorporates tantalum.

25. The method of claim 23 wherein the metallic anode substrate incorporates vanadium.

26. A method of extracting a target element from an oxide feedstock of the target element, the method comprising:

providing a liquid oxide electrolyte in which the oxide feedstock is dissolved forming ionic oxygen species and ionic target element species, the oxide feedstock comprising an oxide of the target element selected from the group consisting of iron, titanium, nickel, manganese, cobalt, zirconium, chromium and silicon;

providing an anode, in contact with the electrolyte at an interface, comprising a metallic anode substrate having at least 50% by weight of a metal selected from the group consisting of scandium, titanium, vanadium, chromium, manganese, iron, cobalt, nickel, zirconium, niobium, molybdenum, hafnium, tungsten and tantalum, the anode having a solid oxide outer layer comprising one or more oxides of a metal selected from the group consisting of chromium and iron;

providing a liquid cathode in contact with the electrolyte;

driving electrons from ionic oxygen species in the electrolyte into the metallic anode substrate across the oxide layer thereon to form gaseous oxygen; and reducing ionic species of the target element in the electrolyte to form the target element at the cathode.

27. The method of claim 26 wherein one of scandium, titanium, vanadium, manganese, iron, cobalt, nickel, yttrium, zirconium, niobium, molybdenum, hafnium, tungsten and tantalum constitutes at least 70% by weight of the metallic anode substrate.

28. The method of claim 26 wherein chromium constitutes at least 70% by weight of the metallic anode substrate.

29. The method of claim 26 wherein the target element constitutes at least 1% by weight of the metallic anode substrate.

30. The method of claim 26 wherein thorium, uranium, beryllium, strontium, barium, hathium, zirconium or yttrium constitutes at least 0.1% by weight of the metallic anode substrate.

31. The method of claim 26 wherein the target element is one of nickel, manganese, cobalt, zirconium, chromium and silicon.

32. The method of claim 26 wherein the target element is iron and the feedstock compound is an iron oxide.

33. The method of claim 26 wherein the target element is titanium.

34. The method of claim 26 wherein the electrolyte comprises an oxide of thorium, uranium, beryllium, strontium, barium, hafnium, zirconium or a rare earth element.

35. A method of extracting iron from an oxide feedstock, the method comprising:

providing a liquid oxide electrolyte comprising at least 75% by weight of one or more oxide compounds, in which the oxide feedstock is dissolved;

providing an anode, including a metallic anode substrate at least 50% by weight of which is chromium and at least 1% by weight of which is iron, in contact with the electrolyte;

providing a liquid cathode in contact with the electrolyte;

driving electrons from oxygen precursors in the electrolyte into the metallic substrate to form gaseous oxygen; and reducing iron-bearing species in the electrolyte to form elemental iron at the cathode.

36. The method of claim 35 wherein the electrolyte comprises oxides of silicon, aluminum, magnesium and calcium.

37. The method of claim 35 wherein the electrolyte comprises an oxide of thorium, uranium, beryllium, strontium, barium, hafnium, zirconium or a rare earth element.

38. The method of 35 wherein a spinel phase develops on the anode during electrolysis.

39. The method of claim 35 wherein the cathode is a liquid iron alloy.

40. The method of claim 39 wherein the iron is formed by reduction at the cathode at a temperature less than 1500° C.

41. An apparatus comprising:

a liquid oxide electrolyte comprising at least 75% by weight of one or more oxide compounds selected from calcium oxide, magnesium oxide, aluminum oxide and silicon oxide, including ionic oxygen species and ionic target element species from an oxide feedstock compound dissolved in the electrolyte;

a liquid cathode in contact with the electrolyte; and an anode, including a metallic anode substrate having at least 50% by weight of chromium and a metal selected from the group consisting of scandium, titanium, vanadium, manganese, iron, cobalt, nickel, zirconium, niobium, molybdenum, hafnium, tungsten and tantalum, the anode having a solid oxide layer comprising one or more oxides selected from the group consisting of the target element, the metallic anode substrate and the electrolyte, the anode in contact with the electrolyte at a contact interface, the apparatus being operable, upon connection of the anode and the cathode to a power source, to electrolyze the dissolved oxide feedstock compound, drive electrons from the ionic oxygen species across the solid oxide layer to form gaseous oxygen and reduce the ionic target element species to form the target element at the cathode.

42. An apparatus comprising:

a liquid oxide electrolyte comprising at least 75% by weight of one or more oxide compounds and comprising an iron oxide feedstock dissolved therein thus forming ionic oxygen species and ionic iron species;

a liquid cathode in contact with the electrolyte; and an anode, including a metallic anode substrate having at least 50% by weight of chromium and at least 1% by weight of iron, contacting the electrolyte at a contact interface, the apparatus being operable, upon connection of the anode and the cathode to a power source, to electrolyze the dissolved oxide feedstock compound, drive electrons from the ionic oxygen species into the anode to form gaseous oxygen and reduce the ionic iron species to form elemental iron at the cathode.

43. The apparatus of claim 42 wherein the cathode is liquid carbon steel.

* * * * *